United States Patent [19]

Ferdinand

[11] 4,397,211

[45] Aug. 9, 1983

[54] CIRCUIT FOR PRODUCING MUSICAL TONES

[75] Inventor: Scott A. Ferdinand, Denver, Colo.

[73] Assignee: Mattel, Inc., Hawthorne, Calif.

[21] Appl. No.: 335,783

[22] Filed: Dec. 30, 1981

[51] Int. Cl.[3] ..... G10H 1/055; G10H 1/22

[52] U.S. Cl. ..... 84/1.26; 84/1.13; 84/DIG. 2; 84/DIG. 8; 84/DIG. 20

[58] Field of Search ..... 84/1.13, 1.24, 1.26, 84/DIG. 2, DIG. 8, DIG. 20

[56] References Cited

U.S. PATENT DOCUMENTS 3,383,453 5/1968 Sharp ..... 84/1.26

3,544,699 12/1970 Harris ..... 84/1.26

*Primary Examiner*—S. J. Witkowski

*Attorney, Agent, or Firm*—Reagin & King

[57] ABSTRACT

A circuit for producing musical tones is disclosed which includes a keyboard for selecting the musical tones, and a tone generator responsive to the keyboard for generating a square wave signal having the frequency of the musical note to be generated. A charging circuit is provided for charging a capacitor to a predetermined level of voltage when the square wave signal is terminated, and for exponentially discharging the capacitor when the square wave signal is initiated. A modulation circuit amplitude modulates the square wave signal in proportion to the capacitor voltage to produce an exponentially decaying signal which simulates the waveform produced by a struck piano string. A speaker is also included to convert the exponentially decaying signal into audible musical tones having the sound of piano notes. The circuit of the invention requires only a small number of components, making it suitable for use in miniature musical toys.

4 Claims, 1 Drawing Figure

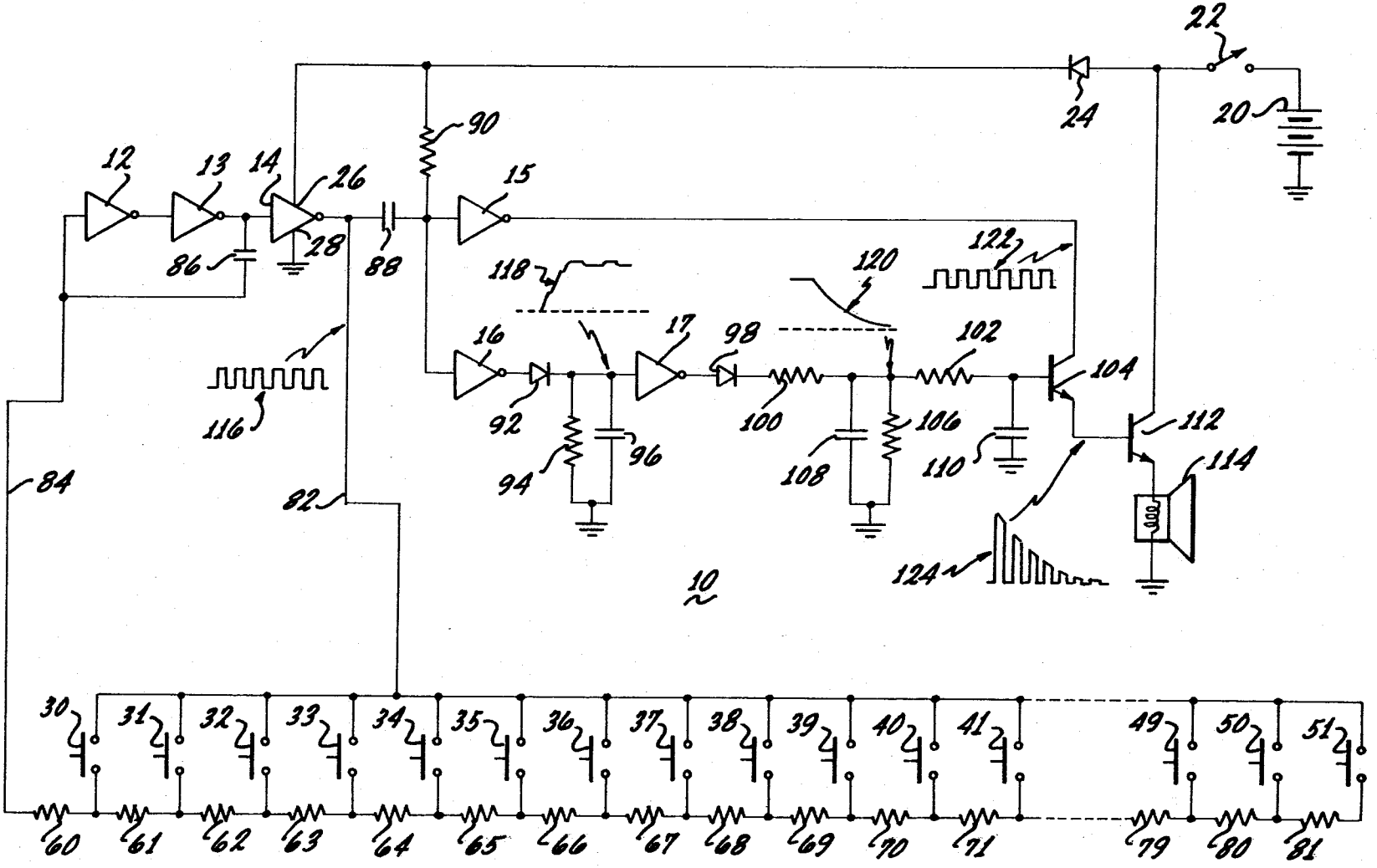
10
12
13
14
15
16
17
20
22
24
26
28
30
31
32
33
34
35
36
37
38
39
40
41
49
50
51
60
61
62
63
64
65
66
67
68
69
70
71
79
80
81
82
84
86
88
90
92
94
96
98
100
102
104
106
108
110
112
114
116
118
120
122
124

CIRCUIT FOR PRODUCING MUSICAL TONES

BACKGROUND OF THE INVENTION

This invention relates to circuits for producing musical tones and, more particularly, to a circuit for producing musical tones which is sufficiently small to be incorporated within a miniature toy musical instrument such as a miniature piano.

Many electronic circuits have been developed over the years for producing musical tones. Some of these circuits include a microprocessor used to process signals from a keyboard and to generate a variety of musical tones in response to these signals. One example of this type of circuit is disclosed in U.S. Pat. No. 4,226,155, issued Oct. 7, 1980, and assigned to the assignee of the present invention.

The use of microprocessors has enabled the construction of rather sophisticated music synthesizers designed to be played as a musical instrument by persons trained in the field of music. Such music synthesizers usually include a variety of controls in addition to a keyboard to enable the user to realistically simulate the sounds of several musical instruments.

Many toy musical instruments have also been developed over the years. Some of these toy instruments are configured in the form of a piano. Generally, these toy pianos include a group of metal bars each of which sounds a tone when struck by a key. The sounds thus produced, however, do not realistically reproduce the sounds of a piano.

Accordingly it is desirable to provide a toy piano capable of producing realistic piano sounds like the sounds produced by music synthesizers of the type described above. It is also desirable to produce a miniature toy piano which is designed to be played by a miniature doll. Such a piano must be both small in size and inexpensive to produce. It has been found, however, that the relatively complicated electronic circuits employed in music synthesizers are both too large and too expensive to be used in a miniature toy piano.

It is accordingly an object of the present invention to provide a new and improved circuit for producing musical tones.

It is another object of the present invention to provide a new and improved circuit for producing musical tones which is sufficiently small and inexpensive to be used in the construction of a miniature toy piano.

SUMMARY OF THE INVENTION

Briefly stated and in accordance with the presently preferred embodiment of the invention the foregoing and other objects are accomplished by providing a circuit which includes a keyboard for selecting musical tones to be generated by the circuit. A tone generator responsive to the keyboard is used for generating a square wave signal only when a musical tone is being selected, the square wave signal having the frequency of the musical tone to be generated. The circuit of the invention also includes a charging circuit responsive to the square wave signal for charging a first capacitor to a predetermined level of voltage when the square wave signal is terminated and for exponentially discharging the first capacitor when the square wave is initiated. A modulation circuit is also provided which is responsive to the square wave signal and the first capacitor voltage for amplitude modulating the square wave signal in proportion to the first capacitor voltage to produce an exponentially decaying signal.

A speaker and amplifier are provided to convert the exponentially decaying signal into an audible musical tone having the sound of a piano note.

Other objects, features and advantages of the invention will become apparent from a reading of the specification taken in conjunction with the drawing.

BRIEF DESCRIPTION OF THE DRAWING

The sole FIGURE is a schematic diagram of the circuit of the invention.

DESCRIPTION OF THE PREFERRED EMBODIMENT

The sole FIGURE is a schematic diagram of the circuit 10 of the present invention. The circuit 10 includes six inverters 12–17. In a preferred embodiment of the invention each of the inverters 12–17 is a complementary metal oxide semiconductor (CMOS) logic gate. It is well known that six such inverters may be produced as a single integrated circuit device housed in one package and known as a hex inverter. A typical device for use in this application is type 74C04 supplied by National Semiconductor.

Operating power is furnished to the circuit 10 from a power source 20 (such as a nine volt transistor battery) connected through an on/off switch 22. Power from the battery 20 is furnished to inverters 12–17 through a diode 24, the purpose of which is to protect the inverters 12–17 from damage caused by the inadvertent reversal of polarity of the battery 20. While the FIGURE shows power applied to terminals 26 and 28 of the inverter 14, these same terminals 26 and 28 (though not shown so) connected) also serve to provide power to all six of the inverters 12–17 which are part of a common integrated circuit.

The circuit 10 also includes twenty-two push button switches 30–51 which represent twenty-two keys of a piano keyboard. One terminal of each of the switches 30–51 is connected in common to a line 82. Twenty-two resistors 60–81 are provided which are connected to form a series circuit beginning with the resistor 60, and ending with the resistor 81. One end of the resistor 60 is connected to a line 84, and one end of the resistor 81 is connected to a terminal of the switch 51. As shown in the FIGURE, one terminal of each of the switches 30–51 is connected to a respective junction of adjacent resistors in the resistor array 60–81.

The operation of the portion of the circuit 10 described above is as follows. Pressing one of the switches 30–51 acts to connect a particular value of resistance across the lines 82 and 84. The switches 30–51 and the resistors 60–81 are interconnected so that sequentially pressing the switches 30–51 causes a sequentially increasing value of resistance to appear across the lines 82 and 84. Thus, pressing the switch 30 causes the resistor 60 to be connected across the lines 82 and 84; pressing the switch 31 causes the series combination of the resistors 60 and 61 to appear across the lines 82 and 84; and pressing the switch 51 causes the series combination of all of the resistors 60–81 to appear across the terminals 82 and 84.

The circuit 10 generates a musical note the frequency of which is inversely proportional to the value of resistance appearing across the lines 82 and 84. Thus, the lower the value of resistance appearing across the lines 82 and 84 the higher the frequency of the musical note produced by the circuit 10. Accordingly, the switch 30 represents the key for producing the musical note of the highest frequency and the switch 51 represents the key for producing the musical note of the lowest frequency. The value of each of the resistors 60–81 is chosen so that pressing each of the switches 30–51 produces a respective whole note in a piano scale of approximately three octaves.

In a preferred embodiment of the invention, the resistors 60–81 may be constructed as a continuous strip of resistive material which is formed, for example, by silk screening a resistive ink onto a suitable substrate in a manner well known to those skilled in the art. The switches 30–51 may be constructed in the form of a membrane switch assembly mounted adjacent to the resistive material, whereby depression of one of the switches 30–51 establishes contact to a respective portion of the resistive element. The construction of a keyboard in the manner described above using membrane switches and a resistive element is well known to those skilled in the art.

Returning to the FIGURE, the line 84 is connected to an input terminal of the inverter 12. An output terminal of the inverter 12 is connected to an input terminal of the inverter 13, and an output terminal of the inverter 13 is connected to an input terminal of the inverter 14. The line 82 is connected to an output terminal of the inverter 14, and a capacitor 86 is connected between the input terminal of the inverter 12 and the output terminal of the inverter 13.

A capacitor 88 is connected between an output terminal of the inverter 14 and an input terminal of the inverter 15, and a resistor 90 is connected between the input terminal of the inverter 15 and the cathode terminal of the diode 24. An input terminal of the inverter 16 is connected to the input terminal of the inverter 15, and an output terminal of the inverter 16 is connected through a diode 92 to an input terminal of the inverter 17.

A resistor 94 and a capacitor 96 are connected in parallel between the input terminal of the inverter 17 and ground. An output terminal of the inverter 17 is connected through a diode 98 to one end of a resistor 100, the other end of which is connected through a resistor 102 to the base terminal of an NPN transistor 104. A resistor 106 and a capacitor 108 are connected in parallel between ground and the junction of the resistors 100 and 102, and a capacitor 110 is connected between the base terminal of the transistor 104 and ground.

The collector terminal of the transistor 104 is connected to an output terminal of the inverter 15, and the emitter terminal of the transistor 104 is connected to the base terminal of a second NPN transistor 112. The collector terminal of the transistor 112 is connected through the switch 22 to the positive supply voltage, and a speaker 114 is connected between the emitter terminal of the transistor 112 and ground.

The operation of the circuit 10 described above is as follows. Operating power is supplied to the circuit 10 by closing the switch 22. The inverters 12, 13 and 14 are connected to form a square wave oscillator, the frequency of which is determined by the value of the capacitor 86 and by the value of the resistance appearing between the lines 82 and 84. When the oscillator is operating, a square wave having the waveform 116 is produced at the output terminal of the inverter 14. The purpose of the capacitor 88 is to AC couple the square wave signal appearing at the output terminal of the inverter 14 to the respective input terminals of the inverters 15 and 16.

If none of the switches 30–51 are pressed, an open circuit appears between the lines 82 and 84 which prevents the oscillator from operating. Accordingly, no square wave signal appears at the output terminal of the inverter 14 and hence no signal is coupled through the capacitor 88 to the input terminals of the inverters 15 and 16.

The resistor 90 acts to bias the input terminals of the inverters 15 and 16 to a high state of approximately nine volts in the absence of the square wave signal from the oscillator. Under this condition, the signals appearing at the output terminals of both of the inverters 15 and 16 will be at a low state of approximately zero volts. With the signal appearing at the output terminal of the inverter 16 at a low state, the capacitor 96 is prevented from charging. Accordingly, the signal appearing at the input terminal of the inverter 17 is also at a low state, causing the signal appearing at the output terminal of the inverter 17 to be at a high state of approximately nine volts. This voltage acts through the diode 98 and the resistor 100 to charge the capacitor 108 to a steady state value of about five volts. The resistor 100 is chosen to have a low value to enable the capacitor 108 to rapidly charge to this steady state value. The voltage appearing across the capacitor 108 acts through the resistor 102 to provide bias to the base terminal of the transistor 104 to bias it into conduction.

As mentioned above, the resistor 90 acts to bias the input terminal of the inverter 15 to a high state in the absence of a closure of any of the switches 30–51. Under this condition, the signal appearing at the output terminal of the inverter 15, and hence the signal appearing at the collector terminal of the transistor 104 is at a low state of approximately zero volts. Thus the bias signal appearing at the base terminal of the transistor 104 is shunted to ground through the base-collector circuit of the transistor 104 and the output terminal of the inverter 15, so that no signal appears at the emitter terminal of the transistor 104. The transistor 112 is connected to drive the speaker 114 in response to the signal appearing at the emitter terminal of the transistor 104. Accordingly, when none of the switches 30–51 are pressed, no sounds are provided by the speaker 114.

The operation of the circuit 10 when one of the switches 30–51 is pressed is described as follows. Inverters 12, 13 and 14 in combination with the capacitor 86 and the resistors 60–81 form a tone generator portion of the circuit 10 which determines the frequency of the musical note to be generated by the circuit 10. When one of the switches 30–51 is pressed, a respective one of the resistors 60–81 is switched across the lines 82 and 84. This causes the inverters 12, 13 and 14 to oscillate which produces a square wave signal at the output terminal of the inverter 14 having the waveform 116 shown in the FIGURE. The frequency of the waveform 116 determines the frequency of the musical note to be generated by the circuit 10. The frequency of the waveform 116 is determined by the value of the resistance appearing across the lines 82 and 84, and as described above, the lower the value of this resistance the higher the frequency of the waveform 116.

The inverters 16 and 17 in combination with the diodes 92 and 98, the resistors 94, 100, 102 and 106, and the capacitors 96 and 108 form a wave shaping portion of the circuit 10 which determines the amplitude of the musical tones generated by the circuit 10. The capacitor 88 acts to couple the waveform 116 to the input terminal of the inverter 16. An inverted form of the waveform 116 thus appears at the output terminal of the inverter 16 and acts through the diode 92 to rapidly charge the capacitor 96. The diode 92 acts to prevent the capacitor 96 from discharging through the inverter 16. When the voltage across the capacitor 96 reaches the switching voltage of the inverter 17 the signal appearing at the output terminal of the inverter 17 switches to a low state. When this occurs, the voltage across the capacitor 108 begins discharging through the resistor 106, and through the resistor 102 in combination with the base circuit of the transistor 104. The diode 98 prevents the capacitor 108 from discharging through the inverter 17. The voltage across the capacitor 108 thus decays in an exponential fashion as shown by waveform 120 in the FIGURE. The amplitude of the waveform 120 represents the amplitude of the musical tones generated by the circuit 10.

The tone generator and wave shaping portions of the circuit 10 are combined using the inverter 15 and the transistor 104 as follows. The capacitor 88 couples the waveform 116 to the input terminal of the inverter 15. Accordingly, an inverted form of the waveform 116 appears at the output terminal of the inverter 15 and at the collector terminal of the transistor 104 as shown by waveform 122 in the FIGURE. The exponentially decaying waveform 120 appearing across the capacitor 108 acts in combination with the transistor 104 to amplitude modulate the waveform 122 to produce a resultant waveform 124 at the emitter terminal of the transistor 104. The capacitor 110 acts as a high frequency filter for the transistor 104. The waveform 124 is a realistic simulation of the waveform produced by a piano string when a piano key is struck. The signal appearing at the emitter terminal of the transistor 104 acts to control the transistor 112 to drive the electromagnetic speaker 114. The inductive nature of the voice coil of the speaker 114 smoothes the waveform 124 to produce a pleasing tone which closely resembles the sound produced by a piano.

From the above description of the operation of the circuit 10, it can be seen that the user may emulate the sound of a piano by sequentially pressing the switches 30–51 to produce the desired musical notes. If more than one of the switches 30–51 are depressed simultaneously, the circuit 10 will produce a note having a frequency equal to that of the highest frequency note selected. This is so because pressing one of the switches 30–51 acts to shunt the switches and associated resistors appearing to the right of that one switch as shown in the FIGURE.

When a single switch 30–51 is pressed, a single musical note is generated by the circuit 10 in the manner described above. To produce multiple notes, it is necessary that the actuated switch be released. When the actuated switch is released, the tone generator portion of the circuit ceases oscillating. Accordingly, the signal appearing at the output terminal of the inverter 16 reverts to a low state. This causes the capacitor 96 to discharge rapidly through the resistor 94, which in turn causes the signal appearing at the output terminal of the inverter 17 to switch to a high state. This signal acts through the diode 98 and the resistor 100 to rapidly recharge the capacitor 108 to the steady state level of about five volts. The capacitor 108 remains charged at that voltage until one of the switches 30–51 is pressed, at which time it again begins exponentially discharging.

The tone generator portion of the circuit ceases operation as soon as the switches 30–51 are released. The feature makes it possible to use the circuit 10 to generate interesting sound effects. For example, be pressing one of the switches 30–51 and then quickly releasing it, the musical tone produced will stop abruptly. Thus, by tapping the switches 30–51 for brief intervals of time one can produce a series of abrupt musical tones.

The circuit 10 of the present invention requires only a small number of components to provide all of the features described above. Because of its simplicity, the circuit 10 may be installed within a miniature toy piano designed to be operated by the hands of a miniature doll. For example, the circuit 10 may be incorporated into a miniature toy piano having dimensions of length and width each less than twelve centimeters.

In a preferred embodiment of the invention, components of the following value may be used:

| Reference Designation | Value |
|---|---|
| 86 | .033 microfarad |
| 88, 96 | .1 microfarad |
| 90 | 100 kilohms |
| 94, 102, 106 | 150 kilohms |
| 100 | 680 ohms |
| 108 | 4.7 microfarads |
| 110 | 47 picofarads |

While the invention is disclosed and a particular embodiment is described in detail it is not intended that the invention be limited solely to this embodiment. For example, while the preferred embodiment employs twenty-two switches to represent a piano keyboard, the invention may be easily modified to operate with more or less switches. Many other modifications will be apparent to those skilled in the art which are within the spirit and scope of the invention. It is thus intended that the invention be limited in scope only by the appended claims.

What is claimed is:

1. A circuit for producing musical tones comprising:

keyboard means responsive to an external command for selecting musical tones to be generated by the circuit;

tone generator means responsive to the keyboard means for generating a square wave signal only when the external command is present, the square wave signal having the frequency of the musical tone to be generated;

a first capacitor;

charging means responsive to the square wave signal for charging the first capacitor to a predetermined level of voltage when the square wave signal is terminated and for exponentially discharging the first capacitor when the square wave signal is initiated, including a first inverter having input and output terminals, means for connecting the input terminal of the first inverter to a high level DC bias source, means for AC coupling the input terminal of the first inverter to the square wave signal, a second capacitor, means for connecting the output terminal of the first inverter to the second capacitor whereby the second capacitor is charged when the square wave is initiated and the second capacitor is discharged when the square wave signal is terminated, a second inverter having input and output terminals, means for applying the voltage appearing across the second capacitor to the input terminal of the second inverter, and means for connecting the output terminal of the second inverter to the first capacitor whereby the first capacitor is charged to the predetermined level of voltage when the second capacitor is discharged, and the first capacitor is discharged when the second capacitor is charged;

modulation means response to the square wave signal and the first capacitor voltage for amplitude modulating the square wave signal in proportion to the first capacitor voltage to produce an exponentially decaying signal; and speaker means responsive to the exponentially decaying signal for providing audible musical tones.

2. The circuit of claim 1 in which the modulator means includes:

a transistor;

means for applying the square wave signal to a first electrode of the transistor; and means for applying the first capacitor voltage to a second electrode of the transistor, whereby the exponentially decaying signal appears at a third electrode of the transistor.

3. The circuit of claim 2 further including:

amplifier means connected to drive the speaker means; and means for applying the exponentially decaying signal to an input terminal of the amplifier.

4. The circuit of claim 2 in which the means for applying the square wave signal to a first electrode of the transistor includes:

a third inverter having input and output terminals;

means for connecting the input terminal of the third inverter to a high level DC bias source;

means for AC coupling the input terminal of the third inverter to the square wave signal; and means for connecting the output terminal of the third inverter to the first electrode of the transistor.

* * * * *

UNITED STATES PATENT AND TRADEMARK OFFICE

Certificate

Patent No. 4,397,211 Patented August 9, 1983

Scott A. Ferdinand

Application having been made by Scott A. Ferdinand, the inventor named in the patent above identified, and Matell, Inc., the assignee, for the issuance of a certificate under the provisions of Title 35, Section 256, of the United States Code, adding the name of Eugene R. Poole as a joint inventor, and a showing and proof of facts satisfying the requirements of the said section having been submitted, it is this 25th day of Sept. 1984, certified that the name of the said Eugene R. Poole is hereby added to the said patent as a joint inventor with the said Scott A. Ferdinand.

Fred W. Sherling,
*Associate Solicitor.*